United States Patent [19]

Osuga et al.

[11] 3,945,895

[45] Mar. 23, 1976

[54] METHOD OF PRODUCING COLORED ANODIC COATING ON ALUMINUM AND ITS ALLOYS

[75] Inventors: Masanori Osuga, Yokohama; Hayao Adachi, Kawasaki, both of Japan

[73] Assignee: Fujisash Industries, Ltd., Kawasaki, Japan

[22] Filed: Dec. 5, 1974

[21] Appl. No.: 529,927

[52] U.S. Cl. ..... 204/58

[51] Int. Cl.[2] ..... C25D 11/10

[58] Field of Search ..... 204/58

[56] References Cited

UNITED STATES PATENTS

| | | | |
|---|---|---|---|
| 3,265,597 | 8/1966 | Neunzig et al. | 204/58 |
| 3,658,665 | 4/1972 | Chretien et al. | 204/58 |
| 3,804,731 | 4/1974 | Yanagida et al. | 204/58 |

*Primary Examiner*—R. L. Andrews

*Attorney, Agent, or Firm*—Kenyon & Kenyon

[57] ABSTRACT

Colored anodic coating of aluminum and its alloys can be obtained by immersing the aluminum or its alloys as an anode in an aqueous electrolyte solution containing aromatic sulfonic acid and at least one of formic acid and formate salts, which solution preferably contains at least one of sulfuric acid and water soluble sulfate or bisulfate salts and by passing electric current through the electrolyte solution for a predetermined time.

13 Claims, No Drawings

METHOD OF PRODUCING COLORED ANODIC COATING ON ALUMINUM AND ITS ALLOYS

The present invention relates to a method of producing a colored anodic coating on aluminum and its alloys by passing a direct current through an aqueous electrolyte solution.

The colored anodic coating on aluminum or its alloys is accomplished by immersing an anode consisting of the aluminum or its alloys, and at least one cathode consisting of stainless steel or other metallic materials into the electrolyte solution and passing direct current between the anode and the cathode. Electrolyte solutions which produce colored coatings and which are already known in the art comprise: sulfophthalic acid and sulfuric acid; phenol sulfonic acid and sulfuric acid; and, sulfosalicylic acid and at least one of sulfuric acid, lactic acid, maleic acid, chresylic sulfonic acid and oxalic acid, etc.

The colors of coatings produced by the conventional electrolytes are rather dull and are not transparent. Said coatings produced by the conventional electrolytes can be stably colored only if an oxide film on the aluminum or its alloy becomes thick, for example 10 microns or more.

The conventional colored coatings may be covered by inorganic or organic paint film, such as thermosetting resin film, when it is desired to use the coated article in a corrosive atmosphere, as the coating by anodic oxidation does not have sufficient weather resistant properties. The conventional colored coatings, however, are not suitable for such applications, because it is difficult to heat aluminum to the drying temperature needed to cure paint coated on the thick oxide film. For example, in a case where thermosetting resin film is employed and is cured at a high temperature, for example 150° C, the colored oxide coatings tend to develop fissures with the result that the coated article is unacceptable for practical application. The film of paint formed on the oxide coating is, therfore, usually cured at such a low temperature that the film of paint does not have the desired properties.

It is, therefore, an object of the present invention to provide a method of producing colored anodic coatings on aluminum and its alloys, the colors of which coatings are more vivid and transparent than the conventional colors.

It is another object of the present invention to economically increase the throwing power of the electrolyte solution so that an increased number of aluminum articles can be dipped in a constant volume of the electrolyte solution.

It is a further object of the present invention to produce a yellowish coating, which could not be obtained in the conventional electrolyte, by incorporating a particular ingredient into the known electrolytes mentioned above.

It is a specific object of the present invention to produce colored anodic coatings having a small thickness, i.e. lower than 10 microns.

Other objects of the present invention will be apparent from the following description of embodiments.

In accordance with the present invention, there is provided a method of producing colored anodic coating on aluminum and its alloys comprising: providing at least one cathode; immersing the aluminum or its alloy as an anode into an aqueous electrolyte comprising aromatic sulfonic acid; passing a direct current through the electrolyte solution between the anode and the cathode to obtain a colored anodic coating on the aluminum; wherein an improvement comprises employing, as said aqueous electrolyte, an aqueous electrolyte solution containing (a) aromatic sulfonic acid and (b) at least one member selected from the group consisting of formic acid and formate salts.

The combination of aromatic sulfonic acid and formic acid to produce colored coatings has not been known prior to the present invention, because an electrolyte containing either aromatic sulfonic acid or formic acid was not recognized as being capable of forming desired coatings on aluminum and its alloys. An electrolyte solution containing only sulfosalicylic acid as the aromatic sulfonic acid has been recognized to bring about electric discharge accompanied by sparks on the surface of aluminum or its alloys. The aluminum treated in this electrolyte solution is exposed to pitting corrosion during the electrolytic coating. This electrolyte solution further does not provide the favorable conditions needed in order to increase the thickness of the oxide film being formed, on the aluminum or its alloys, to a sufficient value. It is also known that an electrolyte solution containing formic acid exclusively, causes the formation of pitting on the aluminum surface and does not provide sufficiently thick coatings even if the electric current density and the voltage are widely changed. In order to form the anodic coating on aluminum using an electrolyte solution containing formic acid exclusively, it is required that the temperature of the electrolyte be raised so as to be close to its boiling point and the formic acid contained in the electrolyte must be in an extremely high concentration. Since monocarboxylic acids, in which the formic acid is included, belong to the monobasic acid category, said monocarboxylic acids dissociate hydrogen in an amount considerably lower than that required to initiate the anode reaction. Accordingly, monocarboxylic acid having low dissociation constants must be present in an extremely high concentration and must be heated also to its boiling point. In addition to these disadvantages, monocarboxylic acids bring about pitting corrosion on the aluminum anode and the destruction of the oxide film, when said monocarboxylic acids are present in the electrolyte solution in a moderate or low concentration. In addition to the low dissociation constants of the monobasic acids, the adsorption of these acids on the aluminum anode is not suitable for forming oxide film on the aluminum compared to the adsorption of polybasic acids. Namely, the monobasic acids dissociating the hydrogen are adsorbed and placed on the aluminum anode in a smaller force than the polybasic acids, thereby failing to homogeneously and actively oxidize the aluminum surface.

Attempts were made to remove one of the disadvantages of monobasic acids, i.e., the inactive adsorption phenomenon of anions dissociated from formic acid, by incorporating another ingredient into the electrolyte solution. According to one of the attempts, an electrolyte solution containing oxalic acid in addition to the formic acid was proposed. This proposed electrolyte solution, however, did not make it possible to produce both vivid, transparent colored coatings and thin coatings. Colored coatings are obtained using the proposed electrolyte solution only when the electrolysis time is extended until the coatings grow to a thickness of approximately 40 microns. According to another attempt, sulfuric acid was added into the electrolyte consisting of formic acid so as to provide an electrolyte with improved electrical conductivity. This attempt, however, also did not prove to be successful, since aluminum treated in this electrolyte solution was still subject to the pitting corrosion.

The present inventors found that aromatic sulfonic acid enables the disadvantages of the formic acid to be overcome. Formic acid in the presence of aromatic sulfonic acid is free from the harmful corrosion effect, thereby ensuring that a stable oxide film can be favorably formed.

As far as the inventors understand the mechanism of coloration, the aromatic sulfonic acid incorporated in the electrolyte solution is decomposed during electrolysis, following which a part of the substances decomposed from the aromatic sulfonic acid remains in the film being formed, allowing vivid colors be developed on the aluminum.

The colors of the oxide film produced by the above process according to the present invention have various hues depending upon, first of all, the thickness of the film and, secondly, on the kinds of material treated. The colors are marked by a high degree of saturation and transparency irrespective of the thickness and the kinds of materials treated.

The throwing power of the electrolyte solution can be increased to twice the throwing power of the conventional electrolyte solution. Therefore, when the aluminum or its alloy shapes are piled in a supporting cage and then dipped in the electrolyte solution, a gap provided between each shape is decreased to half the size of the gap defined between each shape in order to form desired coatings on the shapes according to the conventional electrolyte.

The inventors have also found that formate salts including nickel formate and ammonium formate can be used, with or without formic acid, as the above-described second member of the electrolyte solution so as to achieve the advantageous results mentioned above. Therefore, at least one of formic acid, nickel formate and ammonium formate should be preferably used as one of the essential components of the electrolyte solution.

Further, the aromatic sulfonic acid should preferably be selected from the group consisting of sulfophthalic acid and sulfosalicylic acid.

According to an embodiment of the invention, the electrolyte contains an aromatic sulfonic acid in an amount of from 5 to 500 preferably 10 to 500, g/liter and at least one member selected from the group consisting of formic acid and formate salts in an amount of 5 to 200 g, in terms of the weight of the formic acid, per litre of the electrolyte. The electrolyte solution described may be employed over the following range of operating conditions: 0.5 to 5 ampere/square decimeter of current density; 20 to 120 volts of voltage applied between the anode and the cathode; 1 to 150 minutes of electrolysis time.

The electrolyte should preferably contain from 10 to 40 g/liter of at least one member of the formic acid and formate group. When it is desired to produce a satin finished surface, the content of at least one member from the formic acid and formate group should be in excess of 40 g/liter. In this case, surface defects and seams formed by dies on this basic metal disappear. On the other hand, when lustrous oxide coatings are desired, the content of at least one member from the formic acid or formate group should not exceed 10 g/liter.

The coatings of various hues are produced by adjusting the operation conditions, i.e., the current density, voltage and time period of treatment, so that the thickness of the film is changed within a wide range.

According to another embodiment of the invention, the electrolyte solution containing components within the particular ranges already described, is employed over the following operating conditions: 1 to 3 amperes/square decimeter of a current density; 25 to 80 volts of voltage, and; 5 to 20 minutes of an electrolysis time. In this embodiment, the colored, extremely thin, i.e., 2 microns, coatings can be produced by selecting operating conditions substantially equal to the lower limits of said operating conditions. The thickness of the coatings does not exceed 20 microns when the coating process is carried out at operating conditions substantially equal to the upper limits. This method, which is capable of forming a thinly coated film, provides some advantages. First of all, the time of the electrolytic coating can be shortened by as much as a fourth to a half as compared to the conventional process. Secondly, the thermosetting resin paint coated on the aluminum can be cured at a high temperature, for example 180° C, without danger of generating fissures in the oxide film. In addition, the paint coating is firmly adhered to the surface of the aluminum or its alloys. Thirdly, the qualities of the thinly coated oxide film, such as wear resistance, adhesion and corrosion resistance, are not inferior compared to those of conventional thickly coated film. Fourthly, since the oxide film exhibiting minute pores with a diameter ranging from 100 to 1000 angstoms can be colored when the film reaches a very small thickness, paint can be infiltrated into the pores using an electrodeposit painting method, thereby enabling said electrodeposit coating to be applied on the anodic coated article. Even if a part of the paint, which is deposited on the aluminum surface, exfoliates therefrom, the remaining part of the paint, which is infiltrated into the pores, helps to resist corrosion. The resistance against the alkali solution of the aluminum, which is subjected to the colored anodic coating and then to the painting, is, therefore, superior to the aluminum produced by the conventional method.

According to a further preferable embodiment of the invention, the electrolyte for colored coating of aluminum or its alloys contains (a) aromatic sulfonic acid, (b) at least one first member selected from the group consisting of formic acid and formate salts, and (c) at least one second member selected from the group consisting of sulfuric acid and water soluble sulfate or bisulfate salts. The water soluble sulfate salts include, for example, metal sulfates and ammonium sulfate. The water soluble bisulfates salts include, for example, metal bisulfates and ammonium sulfates. The aforementioned second member enables the electrical conductivity of the electrolyte to be adjusted in a such manner that the electrolytic operation can be carried out at a lower voltage. The second member further promotes the formation of said oxide film and the coloration thereof.

According to still another preferable embodiment the electrolyte contains (a) aromatic sulfonic acid in an amount of from 10 to 500 g/liter, (b) at least one first member selected from the group consisting of formic acid and formate salts in an amount of from 5 to 200 g/liter and (c) at least one second member selected from the group consisting of sulfuric acid and water soluble sulfate or bisulfate salts in an amount not higher than 5 g/liter, more preferably 0.5 to 2 g/liter, and the direct current is passed at a current density of from 0.5 to 5 ampere/square decimeter over a period of 1 to 150 minutes, and a voltage of from 20 to 100 volts is applied between the anode and the cathode.

According to a yet another preferable embodiment of the invention, the electrolyte solution containing said three components within the particular ranges according to the foregoing still another preferable embodiment is employed under the following operating conditions: 5 to 20 minutes; 1 to 3 amperes/square decimeter of current density; 25 to 80 volts of voltage, and; 5 to 20 minutes of electrolysis time, so that the colored coatings have a thickness of from 2 to 20 microns.

The invention will be illustrated by way of the following examples. The aluminum or its alloy used in these Examples had the following compositions.

TABLE 1

| Designation (Form) | Cu | Si | Fe | Mn | Mg | Zn | Cr | Ti | Al |
|---|---|---|---|---|---|---|---|---|---|
| A1100 (sheet) | 0.14 | 0.11 | 0.56 | 0.01 | 0.00 | 0.02 | 0.01 | 0.01 | rest |
| A3003 (sheet) | 0.20 | 0.60 | 0.70 | 1.0 – 1.5 | — | 0.10 | — | — | rest |
| A6063T$_5$ (shape) | 0.10 | 0.2 – 0.6 | 0.35 | 0.10 | 0.45 – 0.90 | 0.10 | 0.10 | 0.10 | rest |

EXAMPLE 1

Aluminum sheets and aluminum alloy shapes were degreased and etched prior to the anodic coating. The aluminum sheets and aluminum alloy shapes were immersed in a solution as an anode and a stainless steel bars were immersed in the solution as cathodes. The conditions of treatment and the results are shown in Table II.

In this table, the prime numbers indicate that the treatments were carried out under the same conditions as those of the basic numbers except for the length of treatment times. The obtained colored oxide films were as hard as the conventional films and exhibited excellent weather resistance.

EXAMPLE 2

The aluminum alloy shapes treated according to conditions No. 6 of Example 1 were subjected to electrodeposit painting. The painted shapes were heated at 180° C for 30 minutes without formation of cracks in the colored oxide film and without discoloration of this film.

Table II

| No. | Aluminum Designation | Aromatic Sulfonic Acid. g/l | Formic Acid or Formate. g/l | Sulforic Acid or Sulfate. g/l | Current Density A/dm$^2$ | Voltage Volts | Temperature °C | Time minutes | Thickness microns | Color |
|---|---|---|---|---|---|---|---|---|---|---|
| 1 | A1100 | Sulfosalicylic acid. 65g/l | Formic Acid. 15g/l | — | 2.0 | 45 – 100 | 20 | 15 | 8 | Yellowish umber |
| 2 | A1100 | Sulfosalicylic acid. 50g/l | Formic acid. 12g/l | Sulfuric acid 0.8 g/l | 3.0 | 45 – 60 | 20 | 12 | 8 | Yellowish umber |
| 2′ | do | do | do | do | do | do | do | 24 | 17 | Umber |
| 3 | A3003 | Sulfosalicylic acid. 65g/l | Formic acid. 15g/l | Sulfuric acid 1g/l | 1.0 | 50 – 70 | 20 | 12 | 3 | Gray |
| 3′ | do | do | do | do | do | do | do | 30 | 7 | Dark gray |
| 4 | A6063T$_5$ | Sulfosalicylic acid. 70g/l | Formic acid. 18g/l | Sulfuric acid 1.2g/l | 1.5 | 45 – 55 | 20 | 12 | 4 | Light umber |
| 4′ | do | do | do | do | do | do | do | 24 | 8 | Yellowish brown |
| 5 | A6063T$_5$ | Sulfosalicylic acid. 70g/l | Formic acid 18g/l | Sulfuric acid 1.2g/l | 3.0 | 45 – 60 | 20 | 12 | 9 | Yellowish brown |
| 6 | A6063T$_5$ | Sulfosalicylic acid. 70g/l | Formic acid 18g/l | Sulfuric acid 1.2g/l | 3.0 | 45 – 80 | 20 | 30 | 22 | Dark brown |
| 7 | A6063T$_5$ | Sulfophthalic acid. 60g/l | Formic acid 15g/l | Sulfuric acid 0.04g/l | 3.0 | 45 – 75 | 20 | 12 | 9 | Umber |
| 8 | A6063T$_5$ | Sulfosalicylic acid. 60g/l | Formic acid 60g/l | Sulfuric acid 0.04g/l | 3.0 | 45 – 75 | 20 | 12 | 9 | Olive (1) |
| 10 | A1100 | Sulfophthalic acid. 70g/l | Ammonium formate 20g/l | Sulfuric acid 1.0g/l | 2.0 | 40 – 80 | 20 | 20 | 10 | Umber |
| 11 | A6063T$_5$ | Sulfosalicylic acid. 65g/l | Nickel formate 40g/l | Sulfuric acid 1.2g/l | 2.0 | 50 – 100 | 20 | 29 | 15 | Light bronze |

Note: (1) The surface was "satin finish."

What is claimed is:

1. A method of producing colored anodic coating on aluminum and its alloys comprising:

providing at least one cathode;

immersing the aluminum or its alloys as an anode into an aqueous electrolyte comprising an aromatic sulfonic acid;

passing a direct current through the electrolyte solution between the anode and cathode to obtain a colored anodic coating on the aluminum;

wherein, an improvement comprises employing, as said aqueous electrolyte, an aqueous electrolyte solution containing (a) aromatic sulfonic acid in an amount of 10 to 500 g/liter and (b) at least one member selected from the group consisting of formic acid and formate salts in an amount of 5 to 200 g, in terms of the weight of formic acid, per liter of the electrolyte.

2. A method according to claim 1 wherein said aromatic sulfonic acid is selected from the group consisting of sulfothalic acid and sulfosalicylic acid, and said direct current is passed at a current density of from 0.5 to 5 ampere/square decimeter over the period of 1 to 150 minutes and a voltage of from 20 to 120 volts is applied between the anode and the cathode.

3. A method according to claim 2, wherein said direct current is passed at a current density of 1 to 3 ampere/square decimeter over the period of from 5 to 20 minutes and a voltage of from 25 to 80 volts is applied, thereby obtaining a colored anodic coating having a thickness ranging from 2 to 20 microns.

4. A method according to claim 1, wherein said aromatic sulfonic acid is at least one selected from the group consisting of sulfophthalic acid and sulfosalicylic acid.

5. A method according to claim 1, wherein said formate salts are nickel formate and ammonium formate.

6. A method according to claim 1, wherein said aromatic sulfonic acid is sulfophthalic acid.

7. A method according to claim 1, wherein said aromatic sulfonic acid is sulfosalicylic acid.

8. A method of producing colored anodic coating on aluminum and its alloys comprising:

providing at least one cathode;

immersing the aluminum or its alloys as an anode into an aqueous electrolyte comprising aromatic sulfonic acid;

passing a direct current through the electrolyte solution between the anode and cathode to obtain a colored anodic coating on the aluminum anode;

wherein an improvement comprises employing, as said aqueous electrolyte, an aqueous electrolyte solution containing (a) aromatic sulfonic acid in an amount of from 10 to 500 g/liter (b) at least one first member selected from the group consisting of formic acid and formate salts in an amount of from 5 to 200 g, in terms of the weight of formic acid, per liter of the electrolyte and (c) at least one second member selected from the group consisting of sulfuric acid and water soluble sulfate or bisulfate salts in an amount not higher than 5g, in terms of the weight of sulfuric acid, per litre of the electrolyte.

9. A method according to claim 6 wherein said aromatic sulfonic acid (a) is selected from the group consisting of sulfophthalic acid and sulfosalicylic acid, and, further said direct current is passed at a current density of from 0.5 to 5 ampere/square decimeter over a period of 1 to 150 minutes and a voltage of from 20 to 100 volts is applied between the anode and the cathode.

10. A method according to claim 9, wherein said second member is contained in the electrolyte in an amount of from 0.5 to 2 g per liter of the electrolyte.

11. A method according to claim 8, wherein said aromatic sulfonic acid is at least one selected from the group consisting of sulfophthalic acid and sulfosalicylic acid.

12. A method according to claim 8, wherein said first member is formic acid.

13. A method according to claim 8, wherein said second member is sulfuric acid.

* * * * *